United States Patent [19]

Prince et al.

[11] 4,034,807

[45] July 12, 1977

[54] INSIDE PIPE WIPER

[75] Inventors: Edgar N. Prince, Great Bend, Kans.; George Spector, New York, N.Y.

[73] Assignee: Edgar N. Prince, Great Bend, Kans.

[21] Appl. No.: 603,799

[22] Filed: Aug. 12, 1975

[51] Int. Cl.[2] ..... E21B 37/02

[52] U.S. Cl. ..... 166/170; 15/104.05

[58] Field of Search ..... 166/170, 172; 15/104.05, 104.16

[56] References Cited

U.S. PATENT DOCUMENTS

| | | | |
|---|---|---|---|
| 3,073,391 | 1/1963 | Hebert | 166/172 |
| 3,171,487 | 3/1965 | Ault | 166/170 |
| 3,251,306 | 5/1966 | Plunk | 166/170 |
| 3,276,520 | 10/1966 | Arnold | 166/170 |
| 3,424,066 | 1/1969 | Moore, Jr. | 166/170 |

*Primary Examiner*—James A. Leppink
*Attorney, Agent, or Firm*—John H. Widdowson

[57] ABSTRACT

A tool for automatically scraping off mud and oil from the inside wall of pipe being lifted during an oil well drilling operation; the tool including an elongated float that fits loosely inside the pipe and which is of a weight so that it floats on the surface of the oil and mud; the upper end of the tool which is above the water and oil level having arcuate wiper blades extending all around that wipe off the inside wall; the tool being dropped down into the pipe when the pipe is intended to be raised.

3 Claims, 5 Drawing Figures

19
15
17
18
22
12
21
16
10
11
20
14
13
5
41
42
43
40

INSIDE PIPE WIPER

This invention relates generally to oil well drilling tools.

It is well known to those skilled in the art that during a drilling operation it is necessary to occassionally change the drilling bit on the lower end of the auger, thus necessitating the lifting of the auger pipe sections out of the hole so to reach the bit. As these pipe sections are being disconnected, the mud and oil inside them runs on the drilling rig floor, where it makes a thick mass so that the floor becomes slippery and a hazard to the men working on the rig. While wipers have been developed for wiping the mud and oil from the outside of the pipe, and which consist of a rubber collar through which the pipe travels, no provision has been made heretofor for cleaning the pipe interior. This dangerous situation is accordingly in want of an improvement.

Therefore, it is a principal object of the present invention to provide a pipe wiper that is designed to wipe the inside wall of an auger pipe as it is lifted from a hole.

Another object is to provide an inside pipe wiper that is quick to install inside a pipe and which then works automatically as the pipe is lifted.

Other objects are to provide an inside pipe wiper which is simple in design, inexpensive to manufacture, rugged in construction, easy to use and efficient in operation.

These and other objects will become readily evident upon a study of the following specification and the accompanying drawing wherein.

Figures 1, 2, 3, 4, 5:
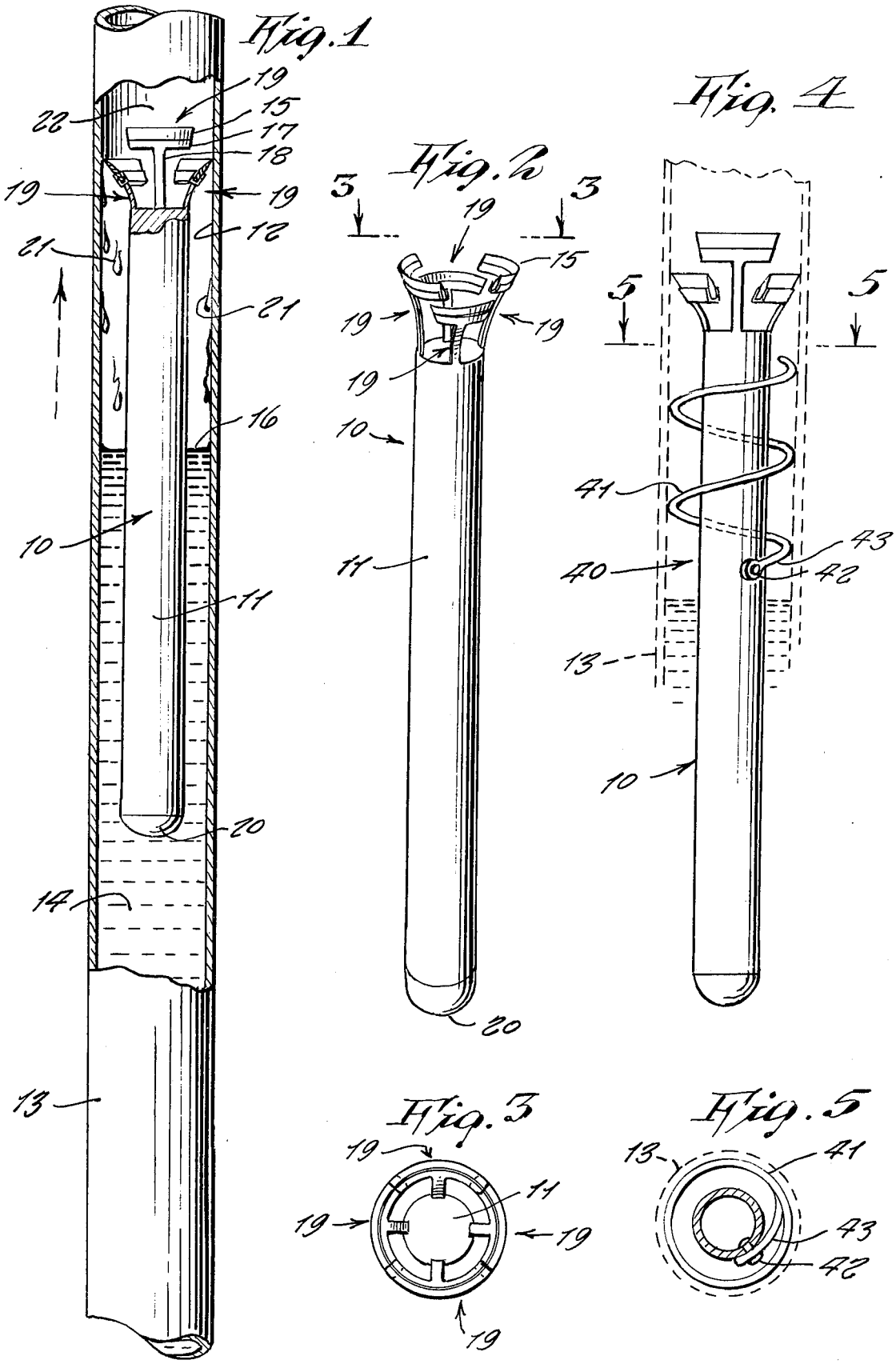
FIG. 1 is a side view of the invention shown in operative use inside a pipe that is being raised.
FIG. 2 is a perspective view of the invention.
FIG. 3 is a top view thereof as viewed on line 3—3 of FIG. 2.
FIG. 4 is a side view of a modified design of the invention which additionally includes a flexible coil spring around its side so to scrape off a main bulk of mud and oil before the pipe reaches the wiper blades which then do the final cleaning.
FIG. 5 is a cross section on line 5—5 of FIG. 4.

Referring now to the drawing in detail, and more particularly to FIGS. 1 through 3 at this time, the reference numeral 10 represents an inside wiper according to the present invention wherein there is a main body member consisting of an elongated barrel 11 that is approximately 24 to 30 inches in length and of a substantially smaller diameter than an inside wall 12 of a drill auger pipe 13. The barrel is constructed of any suitable material and may be hollow so that it is of a specific weight whereby it will float upon a mass 14 consisting of mud and oil, so that wiper blades 15 supported on the upper end of the barrel are approximately 1 foot above the mud and oil level 16.

Each wiper blade 15 is arcuate in shape and to the dimension of the circumferential arc of the pipe, each blade being made of a suitable neoprene or other material held in a metal holder 17 connected to the barrel by a flexible spring steel tongue 18 that urges the blade with force against the inside wall 12.

As shown, these are several blade units 19 thus formed so that the entire wall 12 is engaged thereby. The units 19 are alternately each at a different elevation so that their ends overlap the surface of the wall 12.

The lower end of the pipe is rounded as shown at 20 so that it pilots the barrel to enter the pipe as the pipe is being lifted.

In use, it is now evident that as the pipe is raised, the globules and clumps 21 of mud and oil clinging to the pipe wall 12 after being above the level 16 are engaged by the blades 15 which scrape them off so that these clumps 21 then fall down upon the level 16, leaving a clean surface 22 above the blades, as shown in FIG. 1. Thus the force of gravity is employed by retaining the wiper 10 at the same floating level while the pipe is being pulled upward.

In FIGS. 4 and 5, the above described wiper 10 is used as a component of a modified design of inside pipe wiper 40 wherein there is additionally a flexible coil spring 41 which is of a diameter that is slightly larger than the diameter of the pipe inside wall 12. The spring 41 is made of a suitable material such as spring steel; the spring being fitted around the barrel and secured thereto by a single rivet 42 at a lower end 43 of the spring which extends radially inwardly as shown in FIG. 5 so that the barrel is retained concentrically along the same central axis of the spring whereby it floats in a center of the pipe 13. The coil spring may have a row of teeth along its outer periphery for engaging the wall 12 if so prefered by a manufacturer, or it may be threaded with beads or rollers freely rotatable thereupon the surface of the beads or rollers being toothed so to break up clumps 21 clinging to the wall 12. Thus the major portion of the clumps are removed from the wall 12 before reaching the blades 15 which then only so the final more thorough cleaning.

Thus a modified design is provided.

While various changes may be made in the detail construction, it is understood that such changes will be within the sprit and scope of the present invention, as is defined by the appended claims.

What is claimed is:

1. In an inside pipe wiper, the combination of an elongated barrel which at its upper end supports a plurality of wiper blade units each having a wiper blade for wiping an inside of a pipe, said barrel being of a specific weight so to float upon a surface of a mass of mud and oil with an upper end of said barrel extending upwardly above a surface of said mass, said blade units each comprising a flexible flat spring steel tongue connected to said barrel, said flat tongue normally urging said blades radially outwardly, said blades overlapping each other at their ends.

2. The combination as set forth in claim 1 wherein a compression coil spring is fitted around said barrel and is secured to said barrel at a lower end of said spring.

3. The combination as set forth in claim 2 wherein said coil spring includes teeth means for scraping said inside of said pipe.

* * * * *